US007547353B2

(12) United States Patent
Reyes et al.

(10) Patent No.: US 7,547,353 B2
(45) Date of Patent: Jun. 16, 2009

(54) PULSE GENERATING SYSTEM FOR ELECTROSTATIC PRECIPITATOR

(75) Inventors: Victor Reyes, Soborg (DK); Claus Taarning, Skagen (DK)

(73) Assignee: F.L. Smidth Airtech A/S, Valby (DK)

( * ) Notice: Subject to any disclaimer, the term of this patent is extended or adjusted under 35 U.S.C. 154(b) by 2 days.

(21) Appl. No.: 11/666,338

(22) PCT Filed: Oct. 25, 2005

(86) PCT No.: PCT/DK2005/000686

§ 371 (c)(1),
(2), (4) Date: Nov. 6, 2007

(87) PCT Pub. No.: WO2006/045311

PCT Pub. Date: May 4, 2006

(65) Prior Publication Data

US 2008/0190295 A1 Aug. 14, 2008

(30) Foreign Application Priority Data

Oct. 26, 2004 (EP) ..... 04388072

(51) Int. Cl.
*B03C 3/68* (2006.01)

(52) U.S. Cl. ..... 96/80; 95/81; 96/20; 96/82; 323/247; 323/903; 361/235; 363/44

(58) Field of Classification Search ..... 96/20, 96/21, 80, 82; 95/5, 80, 81; 323/247, 903; 361/225–235; 363/44
See application file for complete search history.

(56) References Cited

U.S. PATENT DOCUMENTS 2,925,142 A * 2/1960 Wasserman ..... 96/21
3,443,358 A * 5/1969 Drenning et al. ..... 95/5
3,745,749 A * 7/1973 Gelfand ..... 96/21
3,877,896 A * 4/1975 Muskovac ..... 96/22
4,052,177 A 10/1977 Kide
4,233,039 A * 11/1980 Schmidt ..... 96/54
4,238,810 A 12/1980 Stevenson et al.
4,445,911 A 5/1984 Lind (Continued)

FOREIGN PATENT DOCUMENTS

EP 0 054 378 A1 6/1982

(Continued)

*Primary Examiner*—Richard L Chiesa
(74) *Attorney, Agent, or Firm*—Jacobson Holman PLLC

(57) ABSTRACT

The invention relates to a pulse generating system for generating high voltage pulses to energize an electrostatic precipitator (10), the system including: a first power supply (1) and a second power supply (2), where said second power supply (2) is arranged to pre-charge said electrostatic precipitator (10) to a DC voltage; a storage capacitor (7) and a series inductance; a switching device (5) coupled in parallel with an anti-parallel rectifier device (6); and wherein the system is arranged to be coupled to the electrostatic precipitator. The invention relates to provide such a pulse generating system with enhanced efficiency compared to present pulse generating systems and with enhanced protection of the components of the system in case of sparks in the electrostatic precipitator (10). This is achieved, when the switching device (5) of the system has turn-off capability and when the system includes a clamping circuit (11-13; 60-67).

10 Claims, 4 Drawing Sheets

U.S. PATENT DOCUMENTS

| | | | | | |
|---|---|---|---|---|---|
| 4,558,404 | A | * | 12/1985 | James | 96/82 |
| 4,592,763 | A | | 6/1986 | Dietz et al. | |
| 4,600,411 | A | | 7/1986 | Santamaria | |
| 4,644,439 | A | | 2/1987 | Taarning | |
| 4,659,342 | A | | 4/1987 | Lind | |
| 4,680,533 | A | * | 7/1987 | Itani et al. | 323/240 |
| 4,698,719 | A | | 10/1987 | Taarning | |
| 4,854,948 | A | | 8/1989 | Eiserlo et al. | |
| 4,867,765 | A | * | 9/1989 | Tomimatsu et al. | 96/82 |
| 4,873,620 | A | | 10/1989 | Neulinger et al. | |
| 5,124,905 | A | * | 6/1992 | Kniepkamp | 363/19 |
| 5,575,836 | A | * | 11/1996 | Sugiura et al. | 96/82 |
| 5,639,294 | A | * | 6/1997 | Ranstad | 95/6 |
| 6,063,168 | A | * | 5/2000 | Nichols et al. | 96/80 |
| 6,282,106 | B2 | * | 8/2001 | Grass | 363/37 |
| 6,611,440 | B1 | * | 8/2003 | Johnston et al. | 363/44 |
| 6,839,251 | B2 | * | 1/2005 | Johnston et al. | 363/44 |
| 7,067,939 | B2 | | 6/2006 | Hartmann et al. | |
| 2008/0017030 | A1 | * | 1/2008 | Fleck | 95/81 |

FOREIGN PATENT DOCUMENTS

| | | | | | |
|---|---|---|---|---|---|
| EP | 0 108 963 | A1 | | 5/1984 | |
| EP | 0 145 221 | A1 | | 6/1985 | |
| EP | 0 212 854 | A1 | | 3/1987 | |
| EP | 386242 | A1 | * | 9/1990 | 96/82 |
| EP | 1 293 253 | A2 | | 3/2003 | |
| GB | 2 068 659 | A | | 8/1981 | |
| GB | 2 183 945 | A | | 5/1987 | |
| SU | 1477477 | | | 5/1989 | |

* cited by examiner

PULSE GENERATING SYSTEM FOR ELECTROSTATIC PRECIPITATOR

This is a national stage of PCT/DK05/000686 filed Oct. 25, 2005 and published in English.

FIELD OF THE INVENTION

This invention relates to a pulse generating system for generating high voltage pulses to energize an electrostatic precipitator (ESP), said system comprising a first power supply and a second power supply, where said second power supply is arranged to pre-charge said electrostatic precipitator to a DC voltage; a storage capacitor and a series inductance; and a switching device coupled in parallel with an anti-parallel rectifier device; wherein said system is arranged to be coupled to said electrostatic precipitator.

BACKGROUND OF THE INVENTION

Electrostatic precipitators can be used for collection and thus removal of particulate from a gas stream in industrial processes. The density of particles in the gas stream can be reduced significantly by charging the particles by, via the discharge electrode of the electrostatic precipitator, generating charge carriers to become attached to the particles in the gas stream, and by applying a high voltage field so that the charged particles are forced towards the positive anode of the electrostatic precipitator, thereby removing the charged particles from the gas stream. The collected particles form a dust layer on the anode of the electrostatic precipitator, which is removed periodically by means of mechanical rapping devices.

The performance of an electrostatic precipitator energized can be impaired when treating high resistivity dust particles. The high resistivity dust causes a high electric field on the dust layer of collected particles in the electrostatic precipitator, which in turn can cause the electrical break-down of the dust layer, a phenomenon known as 'back-corona' or 'back-ionization'.

Back-corona means that positive ions are generated by the breakdown of the dust layer, which neutralizes the beneficial negative ions generated by the discharge electrodes, which are used for charging the dust particles negatively. The result is a decreased voltage applied to the electrostatic precipitator and re-entrainment of the dust particles back to the gas stream due to small eruptions on the dust layer.

In present electrostatic precipitators being pulse energized, typically a smooth DC voltage with superimposed high voltage pulses of short duration is applied to the electrostatic precipitators. The pulse width typically lies in the order of or above 100 μs repeated at a certain frequency in the range of 1 to 400 pulses/s. The average current can be controlled by varying the pulse repetition frequency of a switching device in the system, while maintaining the voltage level applied to the electrostatic precipitator. In this way it is possible to limit or eliminate the generation of back corona and its negative effects to a large extent. It should be noted that the storage capacitor, the switching device and the inductance constitutes a series resonant circuit.

Two main architectures of pulse systems for precipitators exist: one based on switching at low potential and one based on switching at high potential. The first type normally comprises a pulse transformer and the switching takes place on the primary side as explained in U.S. Pat. Nos. 4,052,177, 4,600,411 and EP 0 108 963. EP 1 293 253 A2 is an example of the second type, wherein the switching takes place at a high potential.

U.S. Pat. No. 4,600,411 describes a pulse system with a transformer with a primary and a secondary winding and a thyristor switch. A power supply is connected to a charging inductor in series with a charging capacitor and a surge inductor connected to the primary winding of the transformer. A clamping network comprising a clamping diode and a parallel combination of a resistor and a capacitor is connected between the junction of the surge inductor and the charging capacitor for limiting the voltage across the surge inductor and the primary winding of the transformer.

U.S. Pat. No. 4,854,948 describes another pulse system with a transformer with a primary and secondary winding, a power supply connected to a storage capacitor and a thyristor circuit connected to the primary winding of the transformer. A diode connected to a parallel-connection of a capacitor and a resistor constitute a circuit for protection of the thyristor circuit. A voltage source supplies a base voltage of e.g. 35 kV to an electrostatic dust separator coupled to the secondary winding of the transformer. A detector is coupled to the dust separator for detecting rapid voltage variations that will occur in the event of sparks in the dust separator and for enabling the thyristor circuit to become conducting, thereby protecting the thyristor circuit. However, this detector is increasing the cost of the pulse system.

It is desirable to enhance the efficiency of the systems described in U.S. Pat. No. 4,600,411 and U.S. Pat. No. 4,854,948. Moreover, neither U.S. Pat. No. 4,600,411 nor U.S. Pat. No. 4,854,948 addresses the problem that the core of the transformer becomes saturated upon sparks inside the electrostatic precipitator, which aggravates the operation of the electrostatic precipitator substantially. Finally, the switching devices in the known systems are subject to potentially damaging high rates of di/dt in the case of sparks taking place in the electrostatic precipitator, hereby shortening the life times thereof.

OBJECT AND SUMMARY OF THE INVENTION

It is therefore an object of the invention to provide, a pulse generating system with enhanced efficiency. It is moreover an object of the invention to provide a pulse generating system with a transformer, wherein saturation of the core of the transformer is alleviated. It is moreover an object of the invention to provide a system with enhanced protection of the switching device.

This object is achieved when the pulse generating system mentioned in the opening paragraph is characterized in that the switching device has controllable turn-off capability. Hereby, it is rendered possible to apply pulses with a reduced width to the electrostatic precipitator compared to present pulse generating systems; this provides a substantially enhanced efficiency of the system, according to experiments realized on pilot ESP's, due to a better abatement of back-corona and higher peak voltages giving better particle charging. The switching device could be any appropriate switching device capable of being turned off, e.g. a semiconductor switch such as an IGBT, IGCT, GTO.

In a preferred embodiment the system further comprises a transformer with a primary and a secondary winding, where the first power supply, the storage capacitor, the switching device and the parallel-coupled anti-parallel rectifier device are coupled to the primary winding of the transformer; where the second power supply and a coupling capacitor are coupled to the secondary winding of the transformer; and where the system is arranged to be coupled to the electrostatic precipitator via the coupling capacitor. Hereby, an advantageous embodiment of the system adapted to pulse generating systems of the type comprising a transformer is provided. The storage capacitor is charged by the first power supply to a suitable voltage level and the second power supply generates a base DC high voltage. The coupling capacitor prevents a short circuit of the second power supply by the secondary winding.

In another preferred embodiment of the system, the first power supply is connected to one terminal of a storage capacitor, where the other terminal of the storage capacitor is connected to one terminal of a primary winding of a transformer, and where the other terminal of the primary winding of the transformer is connected to a common terminal. Moreover, the switching device and the anti-parallel rectifier device are connected in parallel, whereof one terminal of the switching device is connected between the first power supply and the storage capacitor and the other terminal of the switching device is connected to the common terminal; one terminal of the secondary winding of the transformer is connected to the common terminal and the other terminal of the secondary winding of the transformer is connected to the electrostatic precipitator via the coupling capacitor; and the second power supply is connected to the junction between the coupling capacitor and the electrostatic precipitator. Hereby, another advantageous embodiment of the system adapted to pulse generating systems of the type comprising a transformer is provided. It should be noted, that the common terminal could be grounded or not depending on the requirements of the power supplies.

During normal operation, it is not unusual that sparks occur inside the electrostatic precipitator. As explained in EP 0 054 378 a spark may occur during the application of a high voltage pulse (in which case the spark is called a "pulse spark") or in the time interval between two consecutive pulses (in which case the pulse is called a "DC-spark"). In the type of pulse generating systems comprising a pulse transformer, the voltage across the coupling capacitor during both types of sparks is connected directly to the secondary winding causing saturation of the pulse transformer and possibly damaging the switching device.

In yet another preferred embodiment, the switching device is arranged to be turned off before the instant in time of the natural zero-crossing of the pulse current applied to the electrostatic precipitator. The switching device can advantageously be turned off just before the instant in time of the natural zero-crossing of the pulse current applied to the electrostatic precipitator. However, the use of a switching device with turn-off capability also allows turning the pulse current at the electrostatic precipitator off well before its natural zero-crossing, if required. Because most of the sparks in the electrostatic precipitator occur close to the instant in time of the zero-crossing of the pulse current at the electrostatic precipitator, which coincides with the peak of the voltage pulse, the switching device will be turned off at the zero-crossing. Thus, if a spark takes place after the zero-crossing of the current at the electrostatic precipitator, the switch will be then already have been turned off. If a spark occurs before this point, the pulse current will increase and the switch should be turned off before the current becomes too high. In both cases it is necessary to include an alternative path for the main current, and this is typically achieved by using a suitable diode network in parallel.

At present, the switching devices used in commercial pulse generating systems are thyristors (SCR). Their inherent natural commutation makes the use of sophisticated protection methods like those described in EP 0 145 221 and EP 0 212 854 necessary. Some sparks result in a voltage surge or overvoltage applied to the switching device. A solution with a free-wheeling diode inserted in parallel with the primary winding like in U.S. Pat. No. 4,600,411 and EPO 0 108 963 has been described.

According to a preferred embodiment of the invention, the system further comprises a clamping circuit connected to the junction between the storage capacitor and the power supply. Thus, the clamping circuit is connected as close as possible to the switching device. Hereby, a path for the current caused by the energy stored in the system (viz. in the leakage inductance of the pulse transformer) is created when the switching device is turned off, thus protecting the switching device by limiting the voltage across it, if the capacitor in the clamping network has a high value. Moreover, the clamping circuit minimizes the saturation of the pulse transformer in the case of sparks, as it takes energy from the system. Preferably, the clamping circuit comprises a diode in series with a capacitor and a resistor in parallel with the diode. The capacitor serves to limit the voltage across the switch during turn-off and the resistor serves to limit the current during discharging of the clamping capacitor when the switch is turned on.

In an alternative, preferred embodiment of the invention, the system comprises a clamping circuit connected to the junction between the storage capacitor and the primary winding of the transformer, the clamping circuit comprising a series connection of a damping resistor, a clamping diode and a capacitor bank. Here, the capacitor bank kept at a suitable voltage, serves to avoid the saturation of the pulse transformer between pulses during normal operation and the damping resistor serves to limit the di/dt in case of pulse sparks considerably.

Preferably, the above clamping circuit moreover comprises an auxiliary DC power supply, a charging resistor, a transistor, a discharging resistor and a reference diode. The auxiliary DC power supply serves to keep the voltage over the capacitor bank limited in case of sparks in the electrostatic precipitator. Hereby, the problems of saturation of the core of the transformer are reduced in that the increase of the voltage in the capacitor bank due to the current surges caused by sparks in the ESP is compensated by a discharge through the discharging resistor and the transistor.

It is preferred that the system according to the invention comprises a snubber circuit connected in parallel to the switching device and the anti-parallel rectifier device. The reason is the stray inductance of the cable connection between the switch and the clamping network. The snubber circuit limits the rate of rise of the voltage across the switching device (dv/dt) when it is turned off; hereby, a protection of the switching device is provided.

Finally, it is preferred that the system according to the invention further comprises a bias network connected to the primary winding of the transformer, where the bias network comprises a voltage source, a limiting resistor and a bias choke. The bias network enhances the efficiency of the transformer core in that it can be magnetized in two polarities; hereby, a smaller and thus cheaper transformer core can be used.

BRIEF DESCRIPTION OF THE DRAWINGS

The invention will be explained more fully below in connection with examples of preferred embodiments and with reference to the drawing, in which.

Throughout the drawings, like elements are denoted by like reference numbers.

DESCRIPTION OF PREFERRED EMBODIMENTS

Figure 1:
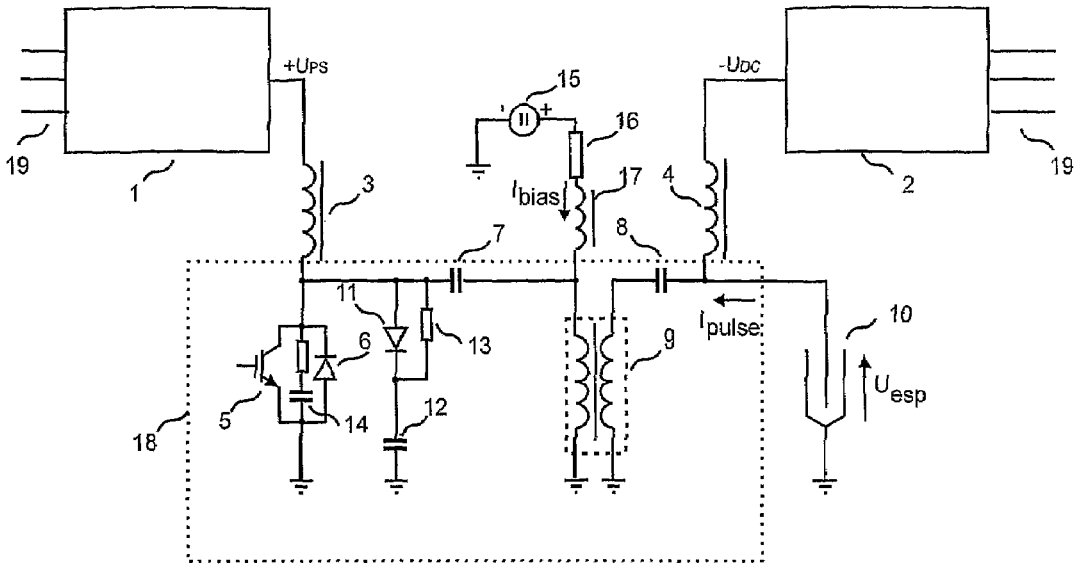
FIG. 1 is a block diagram of the pulse system according to the invention.

FIG. 1 is a block diagram of the pulse system according to the invention. Shown is a first power supply 1, hereinafter referred to as pulse power supply 1, and a second power supply 2, hereinafter referred to as DC power supply 2, arranged to energize an electrostatic precipitator 10. The DC power supply 2 is arranged to pre-charge the electrostatic precipitator 10 to a DC voltage, typically in the range of a 25-50 kilovolts. Both power supplies 1, 2 are fed from a three-phase power line 19.

The reference number 18 denotes the main circuit of the system according to the invention. FIG. 1 moreover shows that the pulse power supply 1 is connected to one terminal of a storage capacitor 7 through a filtering choke 3, whilst the other terminal of the storage capacitor 7 is connected to one terminal of a primary winding of a transformer 9. The other terminal of the primary winding of the transformer 9 is connected to a common terminal. The common terminal could be grounded or not, depending on the requirements of the power supplies.

The main circuit 18 moreover comprises a switching device 5 and an anti-parallel rectifier device 6 connected in parallel, where one terminal of the switching device 5 is connected between the first power supply 1 and the storage capacitor 7 and the other terminal of the switching device 5 is connected to the common terminal. The switching device 5 is a semiconductor switch with turn-off capability, e.g. an IGBT, IGCT, or GTO. A snubber circuit 14 is connected in parallel to the switching device 5 and the anti-parallel rectifier device 6 and consists of a snubber capacitor and a snubber resistor. A suitable value of the capacitance of the snubber capacitor could be some tenths of nF and a suitable value of the resistance of the snubber resistor could be few hundreds Ω.

The main system 18 moreover comprises a series inductance (not shown) in series with the primary winding of the transformer 9. This inductance can be considered as the leakage inductance of the transformer 9 and is therefore not shown in FIG. 1.

One terminal of the secondary winding of the transformer 9 is connected to the common terminal and the other terminal of the secondary winding of the transformer 9 is connected to the discharge electrodes (cathodes) of the electrostatic precipitator 10 via a coupling capacitor 8. The collection electrode or anode of the electrostatic precipitator 10 is connected to the common terminal. The DC power supply 2 is connected to the junction between the coupling capacitor 8 and the electrostatic precipitator 10 through a filtering choke 4.

Moreover, the main circuit 18 contains a clamping network consisting of a diode 11 in series with a capacitor 12 and a resistor 13 in parallel with the diode 11. The clamping network shown in FIG. 1 is connected to the junction between the storage capacitor 7 and the filtering choke 3, i.e. in parallel to the parallel connection consisting of the switching device 5, the anti-parallel diode 6 and the snubber circuit 14. The other terminal of the clamping network 11-13 is connected to the common terminal.

Finally, the system shown in FIG. 1 contains a bias network connected to the primary winding of the transformer 9, where the bias network comprises a voltage source 15, a limiting resistor 16 and a bias choke 17.

The pulse power supply 1 generates a voltage $U_{PS}$ for charging the storage capacitor 7 and the primary winding of a pulse transformer 9 through the filtering choke 3. The pulse transformer 9 typically has a transformation ratio in the range of 15-30. A high voltage DC level at the electrostatic precipitator 10 is created by the DC power supply 2 charging the electrostatic precipitator 10 to the voltage $-U_{DC}$ through the filtering choke 4. Preferably, the inductance of the filtering choke 3 lies between approximately 50 mH and approximately 100 mH and the inductance of the filtering choke 4 lies between approximately 300 mH and approximately 800 mH.

The coupling capacitor 8 connected in series with the secondary winding of the pulse transformer 9 is used for avoiding the short-circuit of the DC supply 2 by the pulse transformer 9. The coupling capacitor 8 is charged to the voltage $-U_{DC}$ through the secondary winding of the pulse transformer 9.

A high voltage pulse is generated when the semiconductor switch 5 is fired and hereby a series oscillating circuit is formed. The series oscillating circuit consists of the storage capacitor 7, the leakage inductance of the pulse transformer 9, which is not shown for the sake of simplicity, the coupling capacitor 8 and the capacitance of the electrostatic precipitator 10 (typically 30-40 pF/m$^2$ of collecting area). The current through the series oscillating circuit has a sinusoidal waveform (see FIG. 2). In the positive half-cycle the current circulates through the semiconductor switch 5 and in the negative half-cycle through the anti-parallel diode 6. In this way the energy not consumed in corona generation and losses is returned to the storage capacitor 7, providing a significant saving of energy.

In order to utilize the core of the pulse transformer 9 more effectively, the pulse transformer is magnetized in the opposed direction previous to the generation of each pulse. This is performed by a bias network consisting of a voltage source 15, a limiting resistor 16 and a blocking choke 17, and as a result a bias current circulates through the primary winding of the pulse transformer 9. Typical values of the voltage source 15 lie between 10 and 20 VDC, whilst the value of the limiting resistor 16 preferably is a few ohms. Moreover, the inductance of the blocking choke 17 advantageously is 0 to approximately 200 mH.

The clamping network connected in parallel with the semiconductor switch 5 consists as mentioned above of a clamping diode 11, a clamping capacitor 12 and a limiting resistor 13. The value of the clamping capacitor 12 is relatively high (typically above 0.5 mF) in order to limit the increase of the voltage to few hundreds of volts when a current pulse circulates through it in the case of a DC spark or when the switch 5 is turned off before or at the current zero-crossing. The value of the clamping resistor 13 preferably is a few hundred ohms.

Because of the parasitic inductance of the cable connection between the switch 5 and the clamping network, the snubber circuit 14 is provided for limiting the rate of rise of the voltage across the switch 5 when the switch is turned off.

Figure 2:
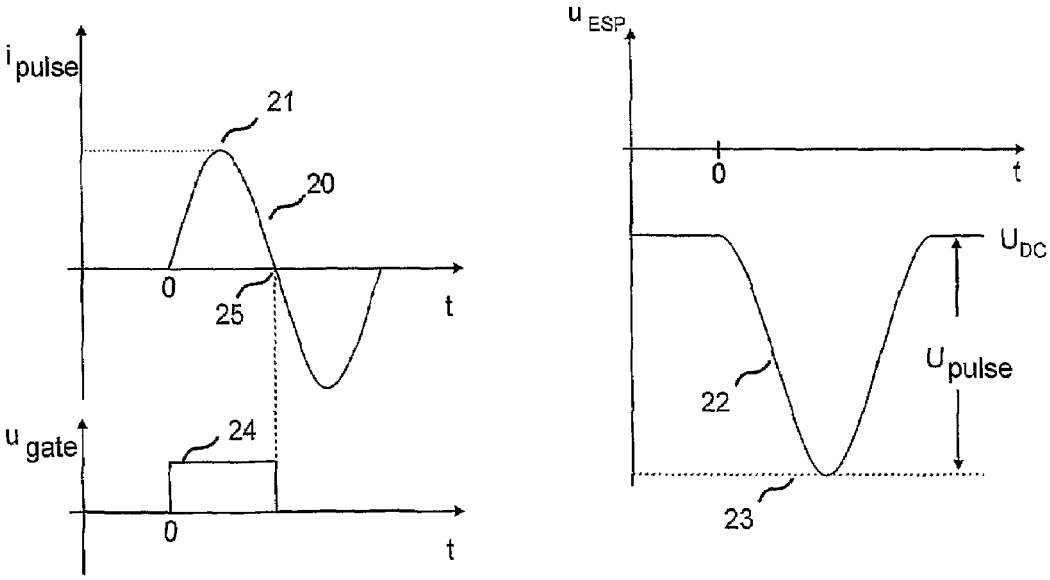
FIG. 2 shows diagrams of the gate voltage applied to the switching device, the voltage across and the current ($i_{pulse}$) through the electrostatic precipitator, during normal operation.

FIG. 2 shows diagrams of the gate voltage applied to the switching device, the voltage across and the current ($i_{pulse}$) through the electrostatic precipitator, during normal operation. Shown is the waveform 20 of the secondary pulse current ($i_{pulse}$), i.e. the current through the circuit containing the secondary winding of the transformer 9, the coupling capacitor 8 and the electrostatic precipitator 10, during normal pulse operation, where the switch is turned off at the zero crossing 25 of the pulse current 20. Moreover, the voltage 22 applied to the electrostatic precipitator 10 is shown during the normal pulse operation. The turn-off of the switch 5 is commanded by the gate signal ($u_{gate}$) 24. The zero-crossing 25 of the pulse current 20 coincides in time with the gate signal 24 going to zero, which is indicated by the reference numeral 25 in FIG. 2. The amplitude of the secondary current pulse 21 is several hundreds Ampere and its duration is well below 100 μs. The amplitude of the voltage 23 (i.e. the amplitude of the smooth DC voltage with superimposed pulses) applied to the electrostatic precipitator 10 can exceed 100 kV.

Figure 3:
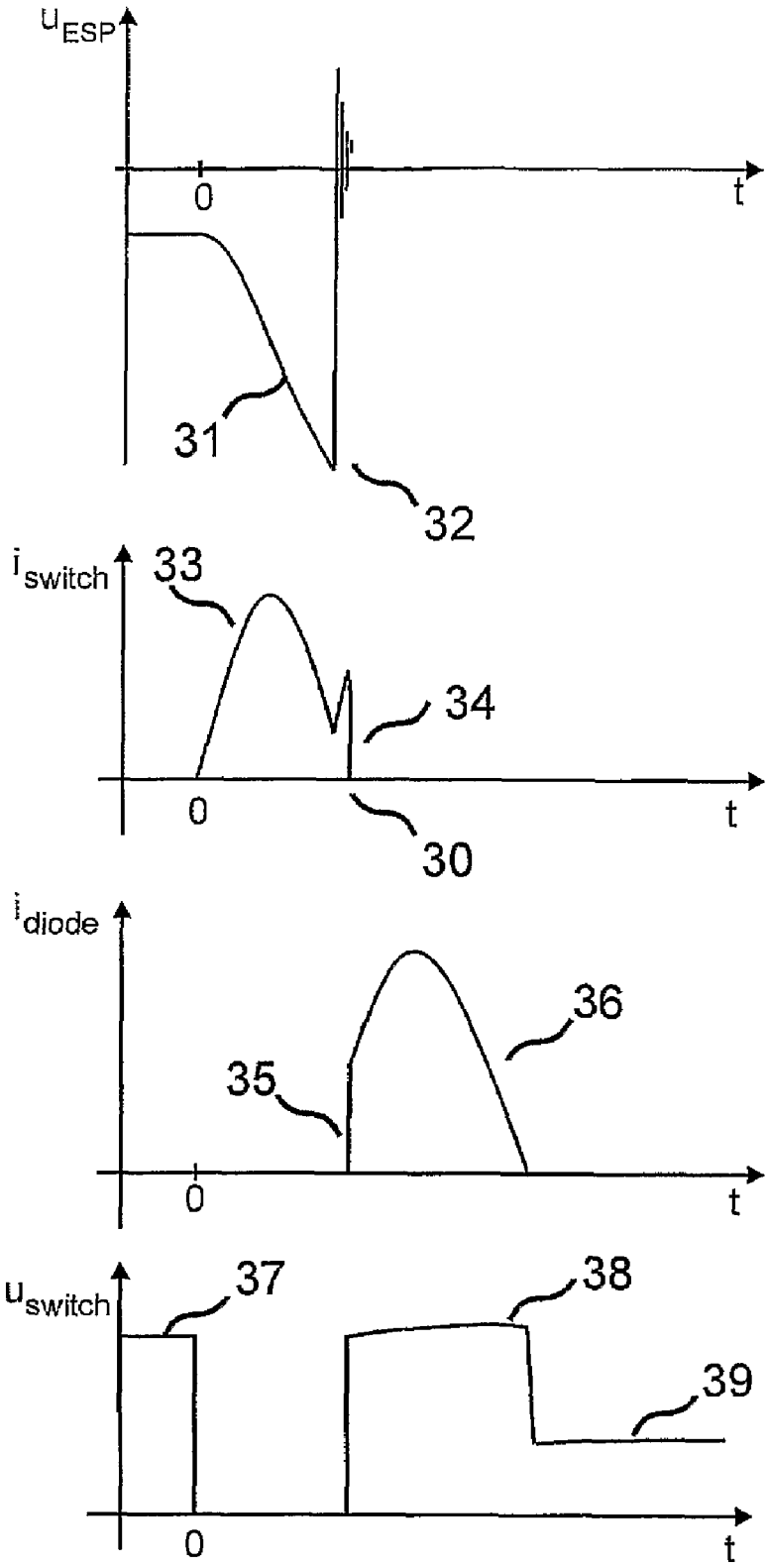
FIG. 3 shows diagrams of waveforms of the voltage across the electrostatic precipitator ($u_{ESP}$), the current through the switching device, the current through the clamping diode in FIG. 1 and the voltage across the switching device, in case of a spark taking place just before the zero-crossing of the current through the switching device.

FIG. 3 shows diagrams of waveforms of the voltage ($u_{ESP}$) applied to the electrostatic precipitator 10, the current ($i_{switch}$) through the switch 5, the current ($i_{diode}$) through the clamping diode 11 in FIG. 1 and the voltage ($u_{switch}$) across the switch 5, in case of a spark taking place just before the zero-crossing of the current ($i_{switch}$) through the switch 5. In FIG. 3 the reference number 31 denotes the waveform of the voltage ($u_{ESP}$) applied to the electrostatic precipitator 10 (see FIG. 1) and the voltage drop caused by the spark is indicated by the vertical rise 32. The reference number 33 denotes the waveform of the current ($i_{switch}$) through the switch 5 (see FIG. 1), the reference number 36 denotes the current ($i_{diode}$) through the clamping diode 11 (see FIG. 1) and the reference numbers 37, 38, 39 denote the voltage ($u_{switch}$) across the switch 5 (see FIG. 1). The reference number 30 denotes the zero-crossing of the current through the switch. The gate signal 24 (see FIG. 2) commanding the turn-off of the switch 5 is the same as in FIG. 2.

Because the spark occurs before the zero-crossing 30, the current through the switch starts increasing at the instant of the spark and then goes to zero when the switch is turned off, i.e. at the instant in time of the anticipated zero-crossing of the current through the switch 5. This is shown as a vertical drop 34 of the waveform 33 of the current ($i_{switch}$) through the switch 5. At this instant in time, the current commutates to the clamping diode 11, which is shown as a vertical rise 35 of the waveform 36 of the current ($i_{diode}$) through the clamping diode 11. It can be seen from FIG. 3, that the clamping diode 11 overtakes the whole surge current. This current has an amplitude of several kA and for avoiding overvoltage across the switch 5, the clamping capacitor 12 has to have a large value, typically in the range of more than 0.5 mF.

As mentioned, a diagram of the waveform 37 of the voltage ($u_{switch}$) over the switch 5 is also shown in FIG. 3. The voltage increase in the switch voltage 37 is only few hundreds volts 38. Immediately after the instant in which the current ($i_{diode}$) 36 through the clamping diode 11 becomes zero, the voltage across the switch 5 falls to a lower value 39 determined by the residual voltage of the storage capacitor 7 and the coupling capacitor 8.

Figure 4:
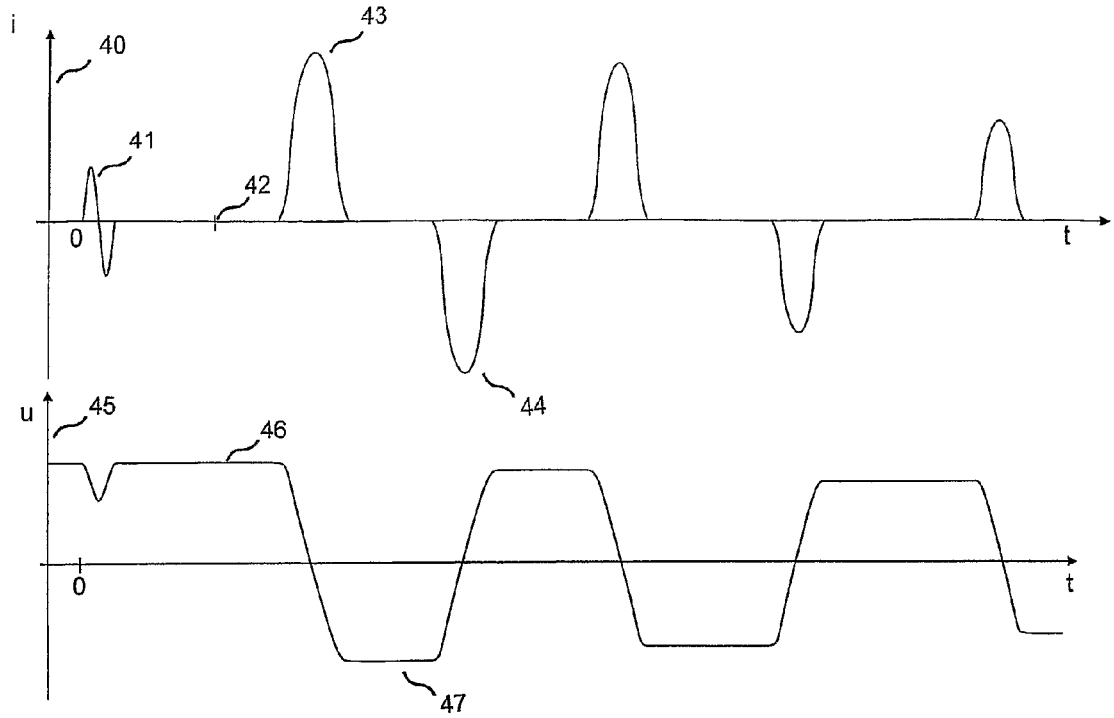
FIG. 4 shows the waveforms of the coupling capacitor voltage and current before, during and after a DC spark, without the use of the clamping network.

FIG. 4 shows the waveforms of the coupling capacitor voltage (u) and current (i) before, during and after a DC spark in the case where the system shown in FIG. 1 does not contain the clamping network (consisting of the clamping diode 11, the clamping capacitor 12 and the limiting resistor 13) shown in FIG. 1.

FIG. 4 shows relevant waveforms 40, 45 in the case, where a DC spark occurs, which causes saturation of the pulse transformer 9 (see FIG. 1). Making reference to FIG. 1, saturation is caused by the coupling capacitor 8 being charged to a voltage equal to $U_{DC}$ that is applied directly to the secondary winding of the pulse transformer 9 when a DC spark takes place in the electrostatic precipitator 10. The waveform 40 of the current (i) through the coupling capacitor 8 and the waveform 45 of the voltage across the coupling capacitor 8 without the use of the clamping network 11-13 shows saturation of the pulse transformer. The DC spark occurs at an instant in time denoted by 42, which is a few milliseconds after a normal current pulse 41. The coupling capacitor 8 is charged to a voltage 46 just below $U_{DC}$, and when the voltage-time integral applied to the core exceeds the maximum flux density thereof, the core becomes saturated and a high current pulse 43 will circulate through the coupling capacitor 8. At the end of this current pulse 43, the polarity of the voltage has become reversed, which is shown by 47. After some time the core is saturated again and a new current pulse 44 will circulate in the circuit, in the opposite direction. As shown in FIG. 4, the amplitudes of the current pulses and the voltage across the coupling capacitor 8 after the DC spark become smaller in time; this is due to losses in the circuit. The above described saturation process of the transformer continues until the energy is considerably reduced due to the losses in the circuit.

During saturation of the transformer the system does not function according to the purpose thereof. Moreover, the saturation current 43, 44 in the secondary winding of the transformer 9 may have an amplitude of more than 1 kA and is therefore detrimental for the lifetime of the main components of the system. By using the clamping diode network the situation is clearly improved, which is illustrated in FIG. 5.

Figure 5:
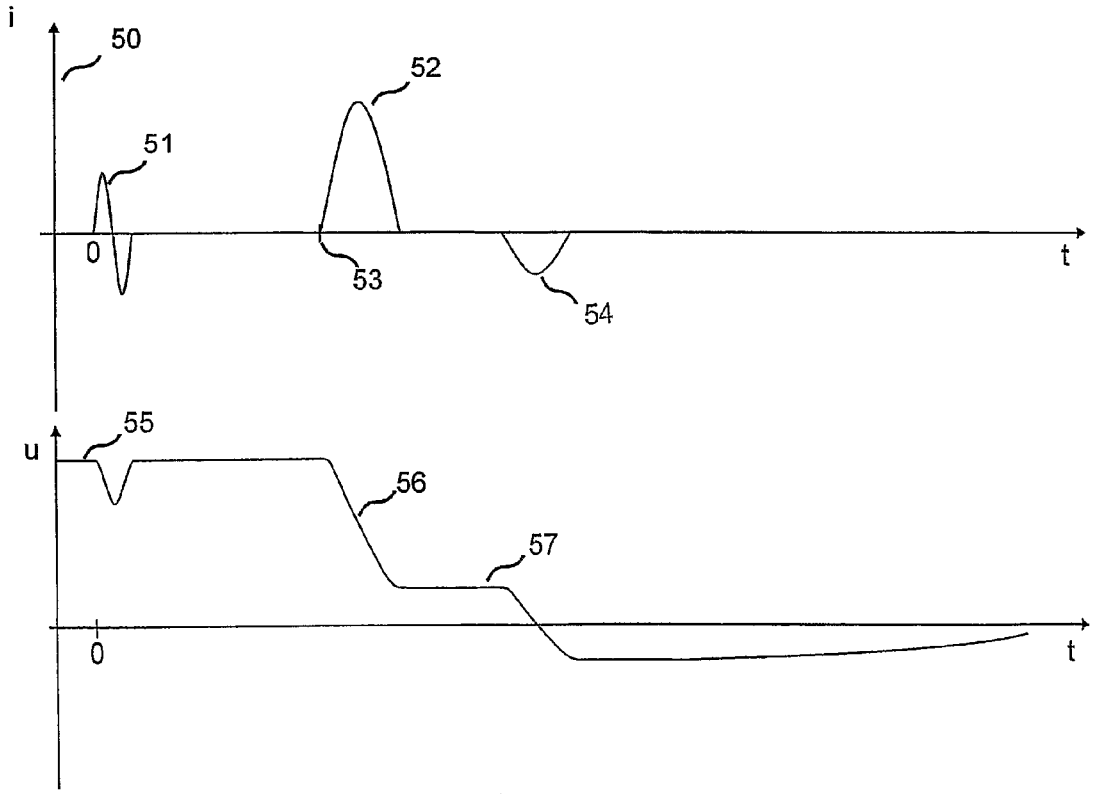
FIG. 5 shows waveforms similar to FIG. 4, during a DC spark, with the use of the preferred clamping network.

FIG. 5 shows waveforms similar to FIG. 4, during a DC spark, with the use of the preferred clamping network 11-13, i.e. in the system shown in FIG. 1. In FIG. 5, the reference numeral 50 denotes the coupling capacitor current and the reference numeral 55 denotes the coupling capacitor voltage. In FIG. 5, a DC spark takes place at the instant in time denoted by 53, i.e. after one normal pulse 51. In this case, the clamping diode 11 is forward biased and a current pulse 52 circulates through the clamping diode 11, clamping capacitor 12, the pulse transformer 9 and the coupling capacitor 8. The amplitude of this current pulse 52 is lower than the amplitude of the current pulse 43 in the case shown in FIG. 4 because of a different circuit impedance due to the inclusion of the clamping circuit 11-13. This current pulse in FIG. 5 discharges 56 the voltage across the coupling capacitor 8 to a certain value 57. Saturation takes place only once, which is shown by the current pulse 54, which discharges the coupling capacitor 8 further. Subsequently, the voltage across the coupling capacitor 8 tends towards zero (and subsequently to the voltage $-U_{DC}$ with superimposed pulses) and saturation will no longer take place. Thus, the clamping network 11-13 substantially enhances the efficiency of the system shown in FIG. 1 and reduces the detrimental effects of high current pulses in the main components of the system.

Figure 6:
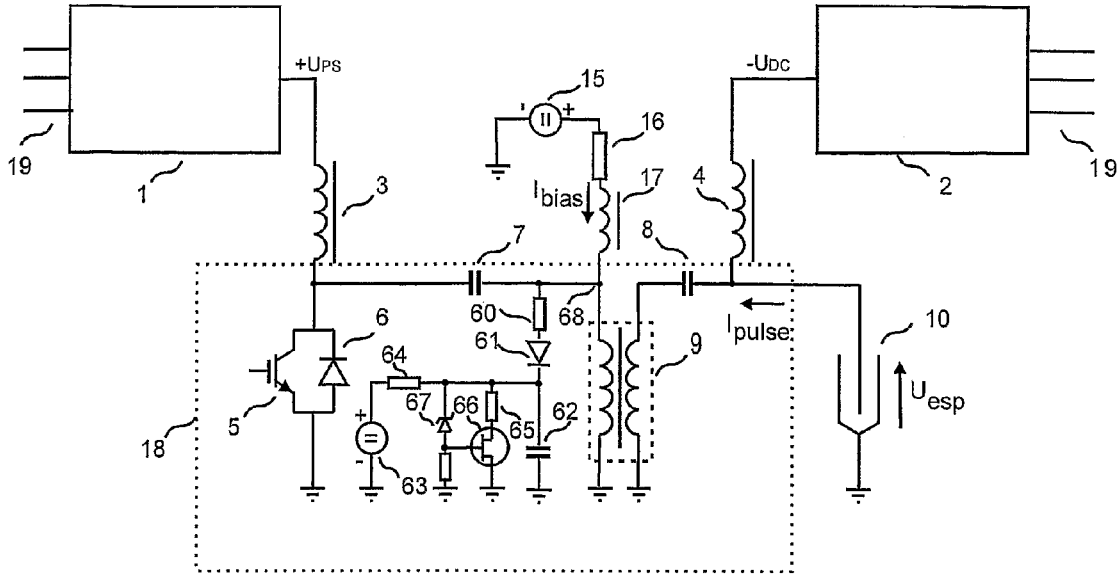
FIG. 6 shows a diagram of a system with an alternative clamping network connected in parallel with the primary winding.

FIG. 6 shows a diagram of a system with an alternative clamping network connected in parallel with the primary winding of the transformer 9. This alternative clamping network is connected to the junction (denoted 68) between the storage capacitor 7 and the primary winding of the transformer 9, and contains a series connection of a damping resistor 60, a clamping diode 61 and a capacitor bank 62 connected to the common terminal. The clamping network moreover contains a series connection of a DC power supply 63 and a charging resistor 64 connected in parallel to the capacitor bank 62. Furthermore, a series connection of a transistor 66 and a discharging resistor 65 is coupled in parallel to the capacitor bank 62. Finally, a reference diode 67 in series with a resistor is coupled in parallel to the capacitor bank 62.

The voltage of the capacitor bank 62 is kept at a constant voltage of about 10-50V by means of the voltage source 63 together with the charging resistor 64, the discharging resistor 65 and the transistor 66. The semiconductor switch 5 is turned off at the current zero crossing (see FIG. 2). In the case, where sparks take place and the switch has been turned off, a high pulse current of several kA will circulate through the clamping network 60-67 raising the voltage across the capacitor bank 62. When this voltage exceeds the aimed level determined by the reference diode 67, the discharging resistor 65 and the transistor 66 will discharge the capacitor bank 62.

The voltage source 63 is necessary for charging the capacitor bank 62 and keeping its voltage at the correct level when the pulse system is switched on, thus avoiding saturation of the pulse transformer.

The damping resistor 60 connected between the live terminal 68 of the pulse transformer 9 and the anode of the clamping diode 61 is arranged for taking energy away from the system in the case of a spark occurring and thereby decreases the rate of rise of the current through the clamping diode. The value of this damping resistor 60 typically is 50 mΩ or more, whilst the value of the charging resistor 64 and of the discharging resistor 65, respectively, is approximately 10Ω or less and approximately 1Ω or less, respectively.

Figure 7:
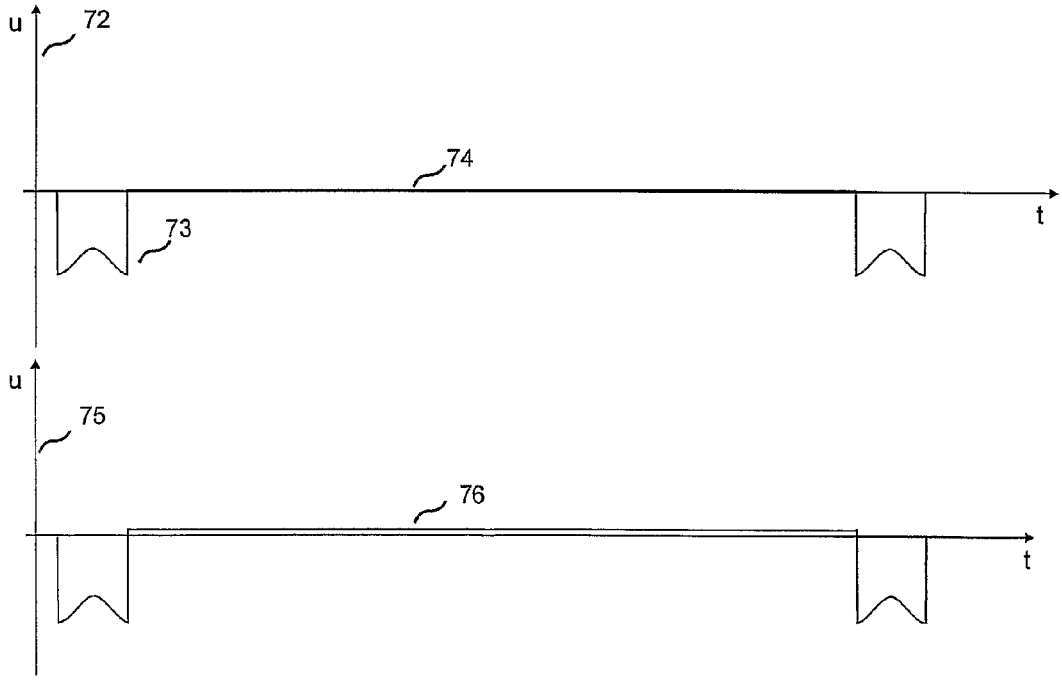
FIG. 7 shows the waveforms of the voltage across the primary winding of the pulse transformer with and without, respectively, the use of the capacitor bank in the alternative clamping network shown in FIG. 6.

FIG. 7 shows the waveforms of the voltage across the primary winding of the pulse transformer 9 with and without, respectively, the use of the capacitor bank 62 and associated circuitry in the alternative clamping network shown in FIG. 6. Thus, FIG. 7 shows the effect of the capacitor bank 62. In FIG. 7, the upper diagram illustrates the waveform 72 of the voltage (u) across the primary winding of the pulse transformer 9 without the use of the capacitor bank 62 and associated circuitry, whilst the lower diagram illustrates the waveform 75 of the voltage (u) across the primary winding of the pulse transformer 9 with the use of the capacitor bank 62 and associated circuitry.

Because of the clamping diode being forward biased during the time interval between two pulses, the amplitude 74 of the voltage applied to the primary winding of the transformer 9 would be clamped by this diode and kept at a voltage equal to the diode forward on-state voltage (<1 V). Then, after a few pulses the core of the pulse transformer 9 would saturate. Therefore, it is necessary to keep this voltage (u) across the primary winding of the pulse transformer 9 at a level of 10-50V by means of the voltage source 63 and the charging resistor 64 as shown by the voltage waveform 75. This voltage level of 10-50 V is denoted by the reference number 76 and must be kept constant, but because of the current pulse generated during sparking, this voltage will tend to increase. The discharging resistor 65 and the switch 66 are intended to perform a function of discharging so that the voltage level 76 can be kept constant.

In applications where a current pulse width above 100 μs is sufficient, a thyristor (SCR) could be used as a switch instead of a switching device with turn-off capability. This thyristor turns off by itself when the current falls below the holding value, but it has to be protected against pulse sparks, e.g. as described in EP 0 212 854. In an application with thyristor the two clamping networks solutions as shown by 11-13 in FIG. 1 and by 60-67 in FIG. 6 could be used, giving the necessary protection of the switching device in case of sparks and minimizing the saturation of the pulse transformer as previously described.

The invention claimed is:

1. A pulse generating system for generating high voltage pulses to energize an electrostatic precipitator (10), said system comprising:

A first power supply (1) and a second power supply (2), where said second power supply (2) is arranged to precharge said electrostatic precipitator (10) to a DC voltage;

A storage capacitor (7) and a series inductance;

A clamping circuit;

A switching device (5) coupled in parallel with an anti-parallel rectifier device (6); and wherein said system is arranged to be coupled to said electrostatic precipitator (10); characterized in that said switching device (5) has a gate electrode and that said switching device (5) has controllable turn-off capability, being controllable by a gate signal supplied to said gate electrode.

2. A system according to claim 1, characterized in further comprising a transformer (9) with a primary and a secondary winding, and in that said first power supply (1), said storage capacitor (7), said switching device (5) and said parallel-coupled anti-parallel rectifier device (6), are coupled to said primary winding of said transformer;

said second power supply (2) and a coupling capacitor (8) are coupled to said secondary winding of said transformer (9); and said system is arranged to be coupled to said electrostatic precipitator (10) via said coupling capacitor (8).

3. A pulse generating system according to claim 1, characterized in that:

said first power supply (1) is connected to one terminal of said storage capacitor (7), where the other terminal of said storage capacitor (7) is connected to one terminal of a primary winding of a transformer (9), and wherein the other terminal of said primary winding of said transformer (9) is connected to a common terminal, said switching device (5) and said anti-parallel rectifier device (6) are connected in parallel, whereof one terminal of said switching device (5) is connected between said first power supply (1) and said storage capacitor (7) and the other terminal of said switching device (5) is connected to said common terminal, one terminal of a secondary winding of said transformer (9) is connected to the common terminal and the other terminal of the secondary winding of said transformer (9) is connected to said electrostatic precipitator (10) via a coupling capacitor (8), and said second power supply (2) is connected to the junction between said coupling capacitor (8) and said electrostatic precipitator (10).

4. A system according to claim 1, characterized in that said switching device (5) is arranged to be turned off before the instant in time of the natural zero-crossing of the pulse current ($i_{pulse}$) applied to the electrostatic precipitator.

5. A system according to claim 1, characterized in that said a clamping circuit (11, 12, 13) connected to the junction between the storage capacitor (7) and the first power supply (1).

6. A system according to claim 5, characterized in that said clamping circuit comprises a diode (11) in series with a capacitor (12) and a resistor (13) in parallel with the diode (11).

7. A system according to claim 1, characterized in that said a clamping circuit (60, 61, 62) is connected to the junction between the storage capacitor (7) and a primary winding of a transformer (9), said clamping circuit comprising a series connection of a damping resistor (60), a clamping diode (61) and a capacitor bank (62).

8. A system according to claim 7, characterized in that said clamping circuit moreover comprises a DC power supply (63), a charging resistor (64), a transistor (66), a discharging resistor (65) and a reference diode (67).

9. A system according to claim 1, characterized in that a snubber circuit (14) is connected in parallel to said switching device (5) and said anti-parallel rectifier device (6).

10. A system according to claim 1, characterized in further comprising a bias network connected to a primary winding of a transformer (9), wherein said bias network comprises a voltage source (15), a limiting resistor (16) and a bias choke (17).

* * * * *